US006336877B1

(12) United States Patent
Arroyo et al.

(10) Patent No.: US 6,336,877 B1
(45) Date of Patent: Jan. 8, 2002

(54) RACKET STRINGING GUIDE RECESSED ON THE FRAME SIDE

(75) Inventors: Pierre-Yves Arroyo, Dardilly; Stéphane Mithieux; Marc Poggi, both of Lyons, all of (FR)

(73) Assignee: Babolat VS, Lyons (FR)

( * ) Notice: Subject to any disclaimer, the term of this patent is extended or adjusted under 35 U.S.C. 154(b) by 0 days.

(21) Appl. No.: 09/581,655

(22) PCT Filed: Nov. 2, 1999

(86) PCT No.: PCT/FR99/02673

§ 371 Date: Jun. 30, 2000

§ 102(e) Date: Jun. 30, 2000

(87) PCT Pub. No.: WO00/25870

PCT Pub. Date: May 11, 2000

(30) Foreign Application Priority Data

Oct. 30, 1998 (FR) ..... 98 13831

(51) Int. Cl.[7] ..... A63B 49/00

(52) U.S. Cl. ..... 473/539; 473/540; 473/521; 473/522

(58) Field of Search ..... 473/539, 540, 473/541, 542, 521, 522

(56) References Cited

U.S. PATENT DOCUMENTS 1,523,865 A * 1/1925 Craig ..... 473/542
3,567,225 A 3/1971 Hollis
3,884,467 A 5/1975 Sommer
4,697,811 A 10/1987 Muroi
4,828,259 A * 5/1989 Davis ..... 473/522
5,280,907 A * 1/1994 Liu ..... 473/539
5,368,297 A * 11/1994 Liu ..... 473/539
5,944,625 A * 8/1999 Janes ..... 473/539 X

FOREIGN PATENT DOCUMENTS

DE 2225595 * 3/1980 ..... 473/FOR 178
DE 3806038 * 9/1989 ..... 473/FOR 178
DE 41 10 698 A1 10/1992

* cited by examiner

*Primary Examiner*—Raleigh W. Chiu
(74) *Attorney, Agent, or Firm*—Oliff & Berridge, PLC

(57) ABSTRACT

A racket includes a frame in which through-holes are made, shank carrying cleats including a pair of shanks which are engaged in the holes, and a stringing mounted on the frame by threading through the shank-carrying cleats, so as to produce a string pattern within the frame. The shank carrying cleats contact the frame between the through-holes. Each cleat has at least one bearing surface which is located between each pair of adjacent shanks and on which a stringing loop bears. At least some of the bearing surfaces include gaps located between the bearing surfaces and the frame.

16 Claims, 3 Drawing Sheets

RACKET STRINGING GUIDE RECESSED ON THE FRAME SIDE

BACKGROUND OF THE INVENTION

The invention relates to the field of game rackets used for sports employing a ball or the like, for example tennis, squash or badminton rackets.

It relates more particularly to rackets in which the string pattern carried by the frame comprises a grid parallel to the longitudinal axis of the handle and composed of vertical strings and a grid perpendicular to the former and composed of cross strings, these vertical strings and cross strings being interlaced, passing alternately above and then below the elements of the other grid.

The string pattern is obtained from at least one string of defined length which, outside the string pattern, passes through the frame of the racket to form a loop having a varied shape, depending on the rackets, and coming to bear on the frame.

The production of the string pattern within a completely manual operation or a manual operation with the assistance of a string bench is carried out according to known techniques.

In addition to the specific stringing operations, the connection between the stringing and the frame also plays an important part in the stability and reliability of the string pattern. Shank-carrying cleats are therefore known, which are mounted on the frame for the engagement of the shanks into holes made for this purpose in the frame. The stringing therefore passes through the frame by way of the shanks intended for guiding and protecting the string passing through them.

DESCRIPTION OF THE PRIOR ART

Shank-carrying cleats are known in the prior art which are produced from flexible material of the rubber type or from rigid material, so as to serve as a support for the loops of the stringing passing through the frame.

Existing rackets have a major disadvantage in that it is difficult to influence the dynamic behavior of their string pattern by means which are simple to use.

SUMMARY OF THE INVENTION

The object of the present invention is to obtain flexibility or elasticity in the string/frame connection, with controlled and, where appropriate, changing rigidity during the tensioning of the stringing or in the event of the impact of a ball.

An additional object is aimed at obtaining a damping of the shocks and vibrations undergone by the string pattern and felt by the player.

The objects of the present invention are achieved with the aid of a racket comprising a frame, in which through-holes are made, shank-carrying cleats, the shanks of which are engaged in the holes, and a stringing mounted on the frame by means of the shank-carrying cleats, so as to produce a string pattern within the frame, said shank-carrying cleats each having at least one bearing surface which is located between each pair of adjacent shanks and on which a stringing loop bears. According to the invention, at least some of these bearing surfaces are assigned to gaps located between said bearing surfaces and the frame.

The objects of the present invention are also achieved with the aid of a shank-carrying cleat which comprises at least two shanks and is intended to be mounted on the frame of a racket and which has at least one bearing surface between two adjacent shanks so as to provide support for stringing. According to the invention, at least one bearing surface is assigned to a gap located between said bearing surface and the frame or between said bearing surface and a part of the cleat intended for coming to bear on or coming opposite the frame.

Thus, in one embodiment of the invention, the frame of the racket is, for example tubular, and each of the holes passing through its respectively inner and outer walls for the passage of a vertical string or of a cross string forms a receptacle for a shank for guiding this vertical string or cross string, and this shank is integral, together with a plurality of other shanks, with a shank-carrying cleat made of semirigid synthetic material molded to the shape of that part of the frame to which it is to be affixed, and at the same time giving the shanks the orientation which they must have when they are engaged in the through-holes of this frame, said cleat comprising, between each group of two contiguous shanks, a bearing surface for the support of the string.

In the embodiments of the racket according to the invention, the gaps extend over the outer periphery of the frame, either in a longitudinal direction or in a transverse direction, and issue or not on the lateral and/or longitudinal flanks of the bearing surfaces.

In another embodiment of the shank-carrying cleats according to the invention, the bearing surfaces have a hole issuing, on the one hand, on the bearing zone of the string and, on the other hand, on the gap.

In other embodiments of the invention, at least some of the gaps are filled with a flexible material in order to damp the deformations undergone by the corresponding bearing surfaces in the event of tension or a shock on the stringing.

In one embodiment, advantageously the flexible material comes into contact with the string and the frame of the racket.

BRIEF DESCRIPTION OF THE DRAWINGS

Other characteristics and advantages will be gathered from the following description, with reference to the accompanying diagrammatic drawings in which.

DESCRIPTION OF THE PREFERRED EMBODIMENT

Figure 1:
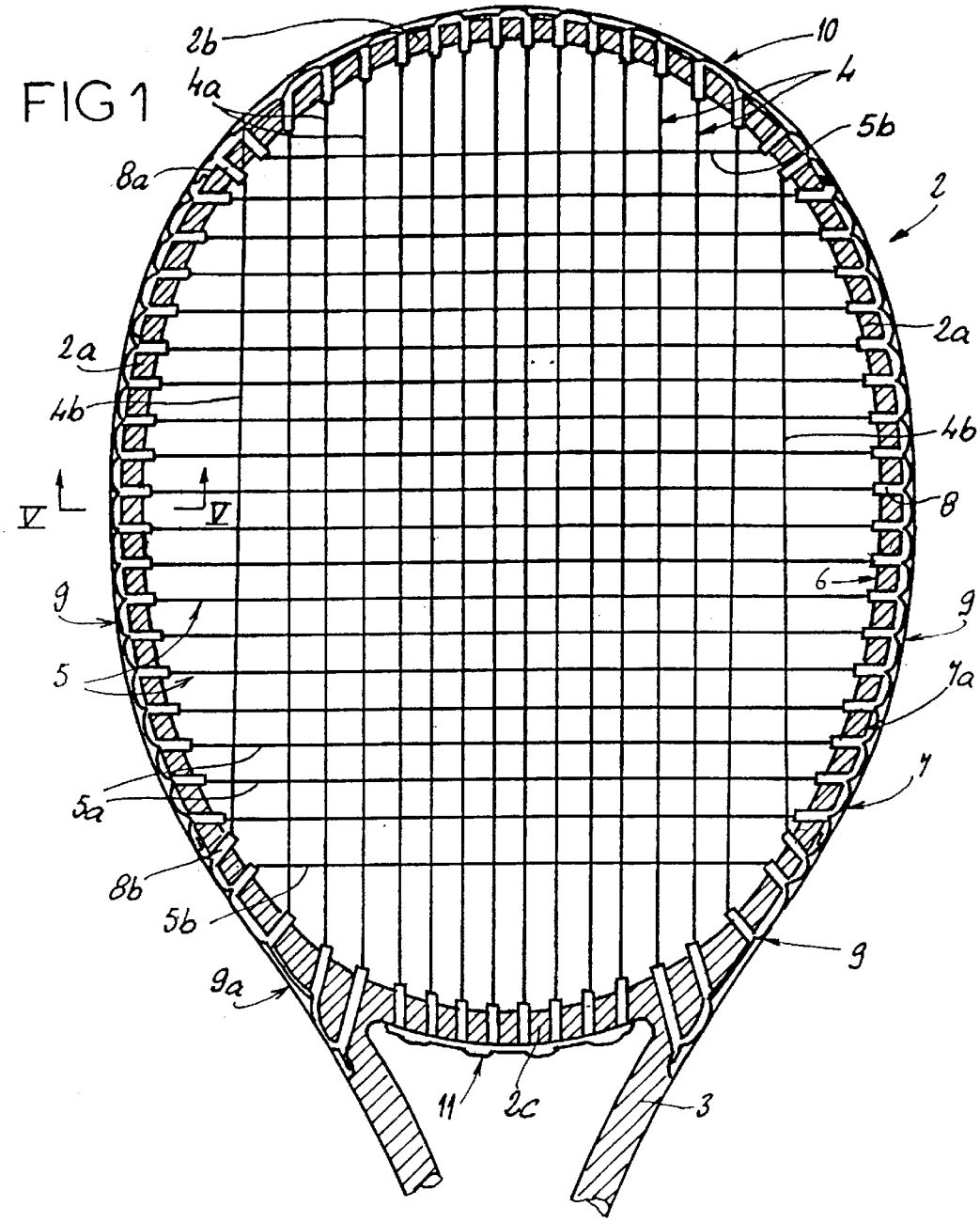
FIG. 1 shows a partial view in longitudinal section of a racket according to the invention.

As shown particularly in the accompanying FIG. 1, the racket comprises a frame 2, itself composed of two lateral parts 2*a*, of a head part 2*b* and of a core part 2*c* integral with gussets 3 for connection to the handle, not shown, and a string pattern composed of vertical strings 4 and of cross strings 5.

Figure 2:
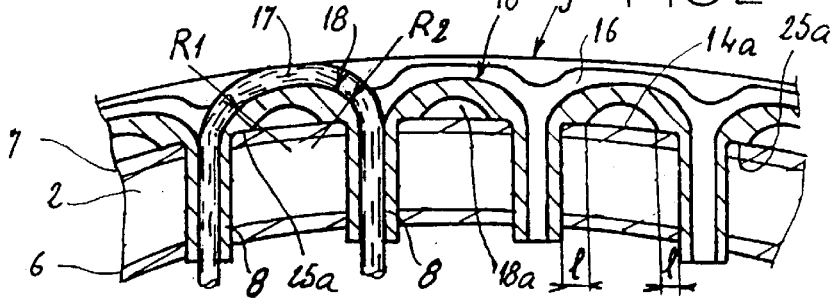
FIG. 2 shows an enlarged partial sectional view of an exemplary embodiment of the racket according to the invention, shown in FIG. 1, FIGS. 3 and 4 show a sectional view of a detail of two other exemplary embodiments of a racket according to the invention.

In FIG. 2, the frame 2 of the racket is produced from composite material of the synthetic fiber/synthetic resin type and is composed of tubular elements. This frame 2 therefore comprises an inner wall 6 and an outer wall 7 which have passing through them through-holes 6*a*, 7*a* pierced, after the production of the racket, for the passage of the string forming the string pattern formed by the interlacing of the vertical strings and cross strings, and, more specifically, for the passage of guide shanks 8. Depending on the particular embodiments, the frame 2 may be solid or recessed.

Advantageously, the shanks 8 guiding the vertical strings 4 and cross strings 5 in their passage through the frame 2 are integral with shank-carrying cleats comprising two lateral cleats 9, a head cleat 10, a core cleat 11 and two extension cleats 9*a*. These various cleats, which are adapted to each racket size, differ from those known at the present time in that they are produced from a synthetic material, for example with a high coefficient of sliding friction, but semirigid, and produced, for example, from 6.6 polyamide with a filler of polytetrafluoroethylene, and are molded to the shape of that part of the frame to which they are to be affixed, at the same time, as a consequence of molding, giving the shanks the orientation which they must have when they are engaged in the holes 6*a*, 7*a* made in this frame. The cleats 9, 10 and 11 therefore comprise, over the greatest part of their length, shanks 8 which are parallel to one another and parallel to the longitudinal axis of the racket, as regards those of the cleats 10 and 11, or perpendicular to this axis, as regards those of the cleats 9. The end shanks 8*a* of the head shank-carrying cleat 10, which are intended for an end cross string and for two end vertical strings, are themselves arranged substantially radially to the frame in order to avoid being interlaced. Likewise, the shanks 8*b* carried by the extension cleats 9*a* and intended for receiving the other end of the end vertical strings 4*b*, an end cross string Sb and the ends of some central vertical strings 4*a* fitting poorly into the curve of the frame 2 on the core side are also arranged substantially radially in relation to this frame.

Advantageously, the frame 2 of the racket comprises, in its outer wall 7, a groove 14 with a bottom 14*a* and having a "U"-shaped cross section. The bottom, of complementary profile, of the corresponding cleats 9 to 11 is embedded in this groove 14. According to an exemplary embodiment shown in FIG. 2, each of these cleats comprises longitudinally a slot 16 having a "U"-shaped cross section transversely matching the shape of the loops 17 connecting two cross strings or two vertical strings and coming to bear on said cleat in the interval between two shanks 8, 8*a*, 8*b*.

As shown in more detail in FIG. 2, each cleat comprises, between each group of contiguous shanks 8, 8*a* or 8*b*, a curved or convex profile delimiting a bearing surface 18 matching the respectively longitudinal and transverse curves of the loop 17 and improving the support of the string. This bearing surface 18 has radii of curvature R1, R2 which vary as a function of the position of the bearing surface 18 on the corresponding part of the frame 2 and so as always to ensure the best possible support of the string forming the loop, without thereby imparting a curvature which may impair its resistance, for example by means of excessive bending stresses.

Each of these bearing surfaces 18 comprises, in its central part, a gap 18*a* or cavity which, for example, issues from its bottom and defines a shoulder 25*a* coming to bear on the bottom 14*a* of the groove 14 of the frame 2.

The length of this gap 18*a* in the convex peripheral direction, also called the longitudinal direction, of the frame 2 is determined in such a way, that, on the one hand, the two parts of the cleat which frame it and which come to bear on the bottom 14*a* of the groove 14 have sufficient length not to impair the rigidity of the connection of this cleat to the contiguous shanks 8 and to prevent any transmission of stresses into these connections, and that, on the other hand, the stringing tension exerted on the string produces virtually no flexion of the bearing surface 18 or produces controlled flexion of said bearing surface, but that, in the event of the impact of a ball on the string pattern, the gaps 18*a* of the stressed bearing surfaces 18 allow a slight flexion of these bearing surfaces, thus giving rise to a reduction in the energy of the shock transmitted to the racket. Thus, the gaps 18*a* give the bearing surfaces 18 of the cleats a shock-damping function.

The degree of damping is therefore determined by the elastic properties imparted to the bearing surface 18, on the one hand, by its shape and, on the other hand, by the properties of its component material.

Figure 3:
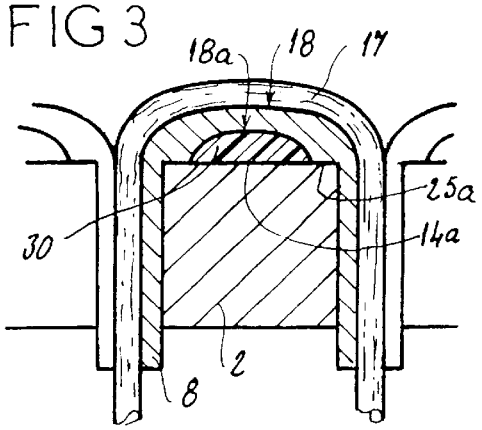
Figure 4:
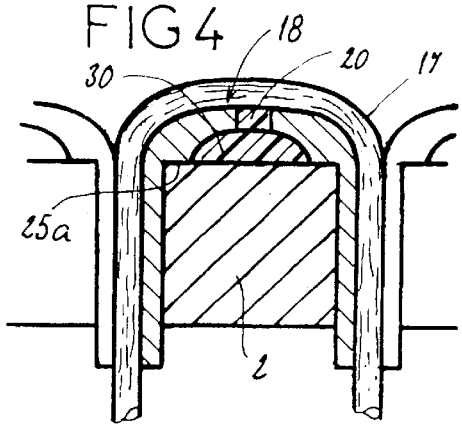

The racket according to the invention, part of which is enlarged and illustrated in FIGS. 2, 3 and 4, has bearing surfaces 18 extending in a longitudinal or convex peripheral direction of the frame 2. These bearing surfaces 18 therefore take the form of bridges or arches on which the string 17 comes to bear.

Advantageously, each of the bearing surfaces 18 comprises, in its central part, a corresponding gap 18*a* in the form of a cavity or empty space, so as to give this central part elastic properties. These bearing surfaces 18 are advantageously curved or incurvate.

Figure 5:
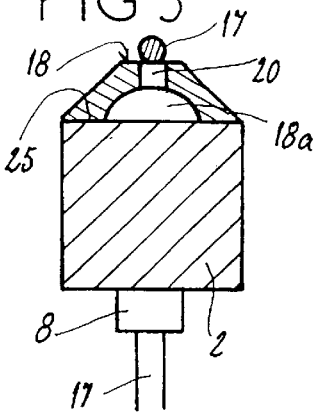
FIGS. 5, 6 and 7 show a section taken in the direction V–V of FIG. 1, with respective embodiments of a racket or a shank-carrying cleat according to the invention.
Figure 7:
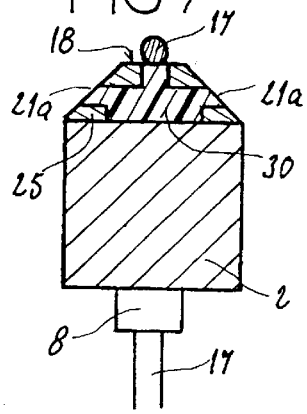
Figure 8:
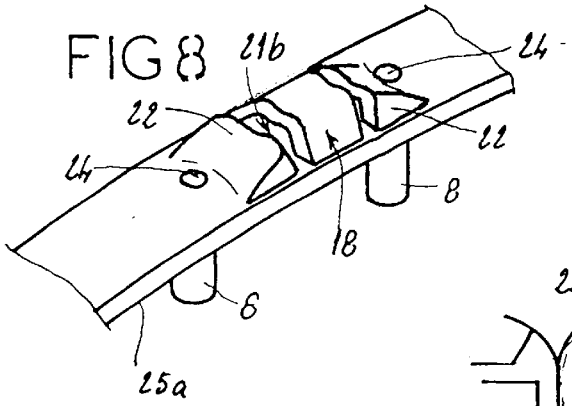
FIG. 8 shows a partial perspective view of an exemplary embodiment of a shank-carrying cleat according to the invention.

In the advantageous exemplary embodiments illustrated, for example, in FIGS. 4, 5 and 7, the bearing surfaces 18 have at least one hole 20 issuing, on the one hand, on the bearing zone of the string 17 and, on the other hand, in the corresponding gap 18*a*.

Figure 6:
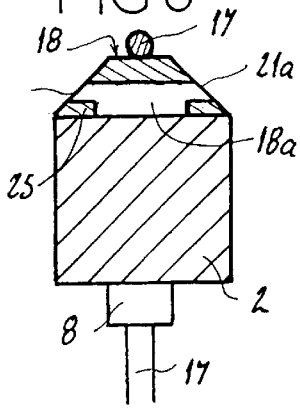

According to the other exemplary embodiments of the shank-carrying cleat which are illustrated in FIG. 6 or 7, the gaps 18*a* issue on the lateral flanks 21*a* of the bearing surfaces 18.

According to other exemplary embodiments illustrated, for example, in FIGS. 8 to 14, the gaps 18*a* issue on the longitudinal flanks 21*b* of the bearing surfaces 18 or transversely to the shank-carrying cleat.

Each of the bearing surfaces 18 therefore comprises, in its central part, the gap 18*a* in the form of a cavity or empty space, so as to give this central part properties of elastic deformation. These properties are obtained by selecting a rigid or semirigid material, the flexion reactions or deformations of which can be determined as a function of stresses applied by the string 17. The actual configuration of these bearing surfaces 18 and of the shank-carrying cleats also contributes to these elasticity properties which, where appropriate, are associated with damping properties linked to the component material of said bearing surfaces 18.

It is therefore expedient to design different shapes of gaps 18*a* which are obtained either by molding or by the clearance of material, so as to give said bearing surface 18 specific elastic properties. The latter rests with its ends on the frame 2 or indirectly via a component strip 25 of the shank-carrying cleat. The bearing surface 18 may also be obtained by the deformation of this strip 25 resting on the bottom 14*a* of the frame 2.

In the exemplary embodiments of the shank-carrying cleat or of the racket illustrated in FIGS. 8 to 14, the bearing surfaces 18 extend in a direction transverse to the frame. This means that the bearing surfaces 18 take the form, for example, of a bridge or arch extending substantially perpendicularly to the plane of extent of the loop formed by the string 17. Thus, according to the exemplary embodiment illustrated in FIGS. 8 and 9, the shank-carrying cleat has complementary supports 22 projecting from the strip 25 and extending on either side of the bearing surface 18. These complementary supports 22 have, for example, an inclined or substantially rounded shape, so as to obtain support along a substantially uniform radius of curvature.

The support in question relates, of course, to a loop of the string 17, the two ends of which engage into bores 24 assigned to the corresponding shank 8. These complementary supports 22 advantageously have a small zone of contact with the string 17, so as not to obstruct the deformation of the bearing surface 18.

Figure 9:
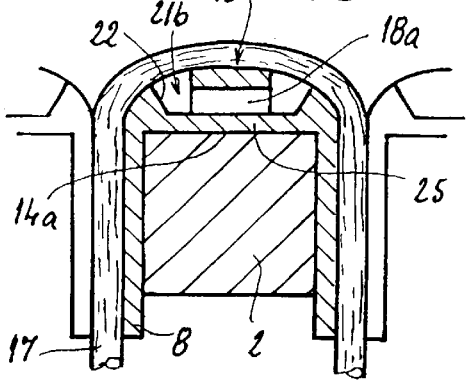
FIG. 9 shows a partial sectional view of a racket frame comprising a shank-carrying cleat shown in FIG. 8.
Figure 10:
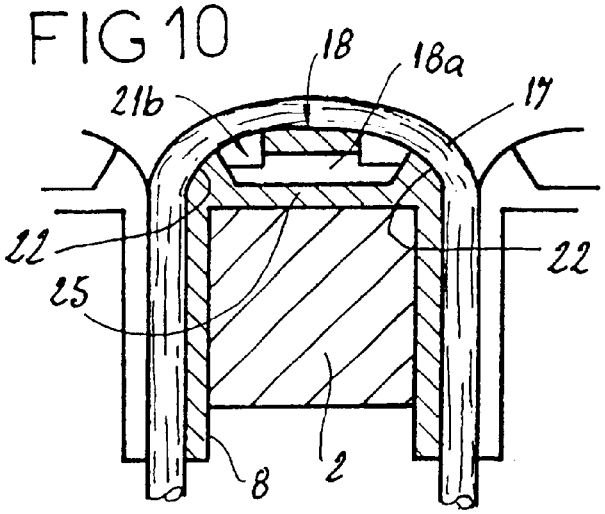
FIG. 10 shows an alternative embodiment of the shank-carrying cleat according to the invention, shown in FIG. 8 or 9, FIGS. 11 and 12 show cross-sectional views of a, for example, tubular frame provided with a shank-carrying cleat according to the invention.

FIG. 10 illustrates another exemplary embodiment of the shank-carrying cleat illustrated in FIG. 9, in which the complementary supports 22 are connected to the base of the bearing surface 18. This results in a gap 18*a* located between the bearing surface 18 and the strip 25 which comes to bear on the frame 2.

Figure 11:
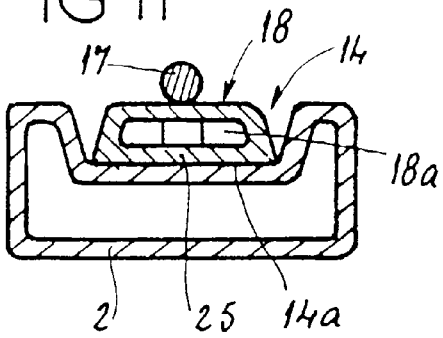
Figure 12:
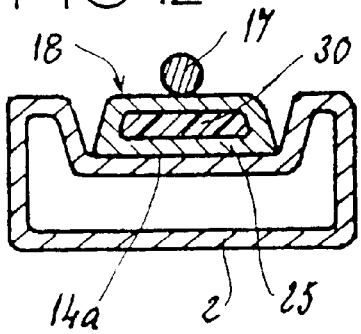
Figure 13:
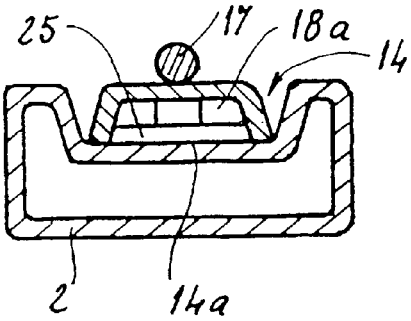
FIGS. 13 and 14 show cross-sectional views of a, for example, tubular frame provided with a shank-carrying cleat produced in another exemplary embodiment according to the invention.
Figure 14:
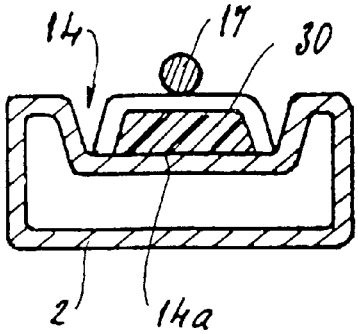

In the exemplary embodiments illustrated in FIGS. 11 and 12, the bearing surface 18 is connected to the strip 25 so as to form a recessed structure thus delimiting the gap 18*a*. The strip 25 comes to rest against the bottom 14*a* of a groove 14 made in the frame 2. The gap 18*a* may also issue on the bottom of the groove 14*a*, as illustrated in FIG. 13 or 14. The strip 25 possesses, for this purpose, an orifice produced by any known means. Here, too, the gaps 18*a* may issue on the lateral and/or longitudinal flanks of the bearing surfaces 18.

FIGS. 11 and 13 thus show that the transverse flanks, that is to say those coming directly opposite the string 17, are open outward.

In a highly advantageous exemplary embodiment of the racket according to the invention and of the shank-carrying cleats according to the invention, at least some of the gaps 18*a* are filled with a flexible material giving the corresponding bearing surfaces 18 damping properties. These properties then make it possible to damp even more the shocks associated with the impact of a ball and to damp the vibrations.

In the exemplary embodiments illustrated in FIGS. 3, 4, 7, 12 and 14, the gaps 18*a* are filled with such a material. The deformation of the bearing surface 18 thus causes a compression of this flexible material 30 which thereby brings about an attenuation of the shocks and vibrations occurring as a result of an impact of a ball on the string pattern of the racket.

Advantageously, this flexible material 30 has a Shore A hardness of between 50 and 70. As an example, this flexible material may be a viscoelastic material. The latter may be overmoulded, adhesively bonded or inserted by any means in the gap and consists, for example, of elastomer of the rubber or silicone type or polyurethane, the hardness of which can be determined accurately.

This flexible material 30 is introduced into all the gaps 18*a* of a shank-carrying cleat or only into a selection of gaps 18*a*.

It is also conceivable to use various types of shank-carrying cleats on the frame 2 of the same racket, some of which comprise a flexible material 30, depending on their positioning on the frame 2, whilst others do not comprise such a flexible material 30, likewise depending on their positioning.

The flexible material 30 may come into contact directly with the bottom 14*a* of the groove 14 made in the frame 2, when said gap 18*a* issues on said bottom 14*a*.

It is thus possible, with shank-carrying cleats according to the invention, to produce a racket, the string pattern of which has varied reactions to shocks and vibrations.

The racket designer thus has available to him, by extremely simple means, a range of physical parameters for carrying out the adjustment of the racket. He can therefore select the component material of the bearing surfaces 18 and their configurations so as to obtain a particular elastic and, if appropriate, damping behavior. The selection of the material 30 thus assigned to the bearing surface 18 in question makes it possible additionally to influence the behavior of the string pattern, particularly with regard to vibrations.

The same applies to the tension of the stringing 17. In fact, depending on the tensioning of this stringing 17, the bearing surfaces 18 are subjected to a prestress generating a greater or lesser deformation of said bearing surfaces 18. Depending on this prestress, a different elastic behavior or a changing rigidity can be obtained for the bearing surfaces 18.

The racket according to the invention has a string pattern, the rigidity of which is controlled, on the one hand, and changing, on the other hand. It is particularly useful to note that action can thus be taken on a large number of parameters influencing the behavior of the racket, without the provision of additional elements or parts attached to the frame or to the string pattern.

In play, the impacts of the ball on the string pattern, which transmit tensile forces to the stressed cross strings and vertical strings, are absorbed much more effectively by virtue of the bearing surfaces 18 of the cleats according to the invention, which make it easier for elongations and forces to be transferred to the contiguous strands of the cross strings and vertical strings of the stringing 17.

This transfer of elongations increases the stressed length of the strings and artificially increases the size of the string pattern, without action being taken on the size of the frame supporting it. The effect of this is to increase the power of the racket, without increasing its overall size.

Likewise, in the event of a hit off center, the transfer of elongation and the slight flexion of the bearing surfaces 18 allow a greater deformation of the string pattern, hence a higher tolerance and a reduction in the amplitude of the shock of the ball on the string pattern.

Finally, the permanent shaping of the cleats and the production of these from rigid or semirigid material prevents the fragile connecting zones between the shanks and cleats from being subjected, as a result of bends when they are being installed, to stresses which may be conducive to incipient fractures, and consequently ensures a long service life for the guidance of the strands of the loops and therefore of the cross strings and vertical strings.

What is claimed is:

1. A racket comprising:

a frame in which through-holes are made;

shank-carrying cleats including a pair of shanks, which are engaged in the through-holes;

and a stringing mounted on the frame by threading through the shank-carrying cleats, so as to produce a string pattern within the frame;

the shank-carrying cleats contacting the frame between the through-holes and each cleat having at least one bearing surface which is located between each pair of adjacent shanks and on which a stringing loop bears, wherein at least some of these bearing surfaces include gaps located between the bearing surfaces and the frame.

2. A racket as claimed in claim 1, wherein each of the bearing surfaces comprises, a central part, the central part comprising the gap in the form of a cavity or empty space made in the shank-carrying cleat, so as to give the central part properties of elastic deformation.

3. A racket as claimed in claim 1, wherein the gaps extend in a direction longitudinal to a plane of extent of the frame and over an outer periphery of the frame.

4. A racket as claimed in claim 1, wherein the gaps extend in a direction transverse to a plane of extent of the frame and over an outer periphery of the frame.

5. A racket as claimed in claim 1, wherein the gaps are curved.

6. A racket as claimed in claim 1, wherein at least some bearing surfaces each have at least one hole issuing, on the one hand, on a bearing zone of the string and, on the other hand, on the gap.

7. A racket as claimed in claim 1, wherein at least some of the gaps are filled with a flexible material, in order to damp the deformations undergone by corresponding bearing surfaces in an event of tension or a shock on the stringing.

8. A racket as claimed in claim 7, wherein the flexible material comes into contact with the string and with the frame.

9. A racket as claimed in claim 7, wherein the flexible material has a Shore A hardness of between 50 and 70.

10. A racket as claimed in claim 1, wherein the gaps issue on at least one of lateral and transverse flanks of the shank-carrying cleat.

11. A racket as claimed in claim 1, wherein at least some of the gaps issue on a wall external to the frame.

12. A shank-carrying cleat which comprises at least two shanks and is intended to be mounted on a frame of a sports racket and which has at least one bearing surface contacting the frame between two adjacent shanks, so as to provide support for a stringing, wherein at least one bearing surface is assigned to a gap located between the bearing surface and the frame or between said bearing surface and a part of the cleat intended to come to bear on or come opposite the frame.

13. A shank-carrying cleat as claimed in claim 12, which comprises a longitudinal slot for receiving loops formed by the string, the longitudinal slot having a substantially "U"-shaped cross section matching a shape of the string and connected to a bore of each guide shank by means of a curved profile delimiting the bearing surface and matching longitudinal and transverse curves of the string.

14. A shank-carrying cleat as claimed in claim 12, which is produced from semirigid synthetic material molded to a shape of that part of the frame to which it is to be affixed, at the same time giving the shanks an orientation which they must have when they are engaged in the through-holes of this frame, the cleat comprising, between each group of two contiguous shanks, a bearing surface for support of the string.

15. A shank-carrying cleat as claimed in claim 12, which is obtained by molding.

16. A shank-carrying cleat as claimed in claim 12, which comprises a flexible material filling at least some of the gaps.

* * * * *